US011585083B2

(12) United States Patent
Magas

(10) Patent No.: US 11,585,083 B2
(45) Date of Patent: Feb. 21, 2023

(54) PANELIZED PRE-FINISHED SIDING SYSTEM AND METHOD

(71) Applicant: Blair Magas, Sherwood Park (CA)

(72) Inventor: Blair Magas, Sherwood Park (CA)

( * ) Notice: Subject to any disclaimer, the term of this patent is extended or adjusted under 35 U.S.C. 154(b) by 0 days.

(21) Appl. No.: 16/678,967

(22) Filed: Nov. 8, 2019

(65) Prior Publication Data

US 2020/0149272 A1 May 14, 2020

Related U.S. Application Data

(63) Continuation-in-part of application No. 16/184,475, filed on Nov. 8, 2018, now abandoned.

(51) Int. Cl.
*E04B 1/62* (2006.01)
*E04F 13/08* (2006.01)

(52) U.S. Cl.
CPC ..... *E04B 1/62* (2013.01); *E04F 13/0801* (2013.01)

(58) Field of Classification Search
CPC . E04F 13/0866; E04F 13/007; E04F 13/0878; E04F 13/0869; E04F 13/0894; E04F 13/24; E04B 2/28; E04C 2/205; E04C 2/243; E04C 2/288; E04C 2/46; E04C 2/521
See application file for complete search history.

(56) References Cited

U.S. PATENT DOCUMENTS 4,551,958 A * 11/1985 Reneault ..... E04F 13/007 52/309.4
7,762,040 B2 * 7/2010 Wilson ..... E04F 13/0864 52/518
10,513,855 B2 * 12/2019 Feys ..... E04F 13/0894
2005/0081468 A1 * 4/2005 Wilson ..... E04F 13/007 52/528
2006/0185299 A1 * 8/2006 Poupart ..... E04C 2/296 52/545
2007/0261353 A1 * 11/2007 Cullen ..... E04F 13/04 52/590.2
2010/0242398 A1 * 9/2010 Cullen ..... B32B 3/06 52/588.1
2011/0258944 A1 * 10/2011 Radoane ..... E04B 2/58 52/62
2012/0096790 A1 * 4/2012 Wilson ..... E04F 13/0864 52/302.1
2013/0247493 A1 * 9/2013 Culpepper ..... E04F 13/075 52/309.4
2014/0150362 A1 * 6/2014 Propst ..... B32B 5/26 52/309.12
2014/0260058 A1 * 9/2014 Olma ..... E04F 13/0871 52/588.1

* cited by examiner

*Primary Examiner* — Gisele D Ford
(74) *Attorney, Agent, or Firm* — Orin Del Vecchio

(57) ABSTRACT

A panelized pre-finished siding system with a locking edge. The device is a pre-finished stucco siding panel system that can be installed in any weather condition without extra preparation or consideration. The system has "SL" trim lock system that can be installed by professionals or can be used by the DIY (do-it-yourselfer). It provides a weather tight cladding system that adds beauty and insulation value to the building envelope.

8 Claims, 7 Drawing Sheets

PANELIZED PRE-FINISHED SIDING SYSTEM AND METHOD

CROSS-REFERENCE TO RELATED APPLICATIONS

This continuation-in-part application claims priority based upon U.S. patent application Ser. No. 16/184,475, filed Nov. 8, 2019, in the name of Blair Magas and entitled: "Panelized EIFS Stucco-Siding System and Method", which is hereby incorporated by reference for all purposes.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of static structures (e.g., buildings) of existing art and more specifically relates to panels.

RELATED ART

Many people in modern society live in dwellings and work in commercial buildings. There are many different finishes on these buildings. The finishes are designed to be esthetic and to protect the building from being degraded by environmental elements such as rain, sun, snow and the like. One such finish is stucco. Stucco is relatively durable and is cost-effective to install. However, many times stucco can be difficult to install on-site especially during hot or cold weather conditions. In situ stucco application can be a labor intensive process that often requires ideal or near-ideal conditions to complete. There is currently no "all season" solution for stucco be it for siding or in-situ applications. A suitable solution is desired.

U.S. Pat. No. 5,987,835 to Ned Santarossa relates to an exterior insulating finish panel system. The described exterior insulating finish panel system includes a method of cladding a building wall surface with individual prefabricated panels and trim mouldings with any fasteners and joints between the panels and trim being covered on site with a coating of stucco to produce a flush finished stucco surface. Each panel has a uniform transverse cross-sectional profile, and a core of foam material coated with a weatherproof stucco coating on its exterior surface. Tongue and groove joints are disposed along the longitudinal surfaces and a longitudinal recess in the exterior surface adjacent each tongue and groove joint is adapted to receive a layer of joint coating to fill the recess and cover the longitudinal joints flush with the external surface. The wall surface is installed by cutting the elongate cladding panels to the approximate length of the wall and mounting the cladding panels temporarily to the wall substrate, such as plywood for example. The exterior surface of the panels is aligned to a predetermined outside finish datum and fasteners secure the cladding panels to the substrate without creating a thermally conductive bridge between the substrate and the external ambient atmosphere. The openings around doors and windows, vertical corners and other details are finished by cutting, mounting and affixing elongate transverse end trim mouldings to cover the end surfaces of the cladding panels. Installation is completed by applying a joint coating to cover the joints and filling the adjacent recesses flush with the exterior surface of the panels, then applying a final finish coat to the entire wall assembly.

SUMMARY OF THE INVENTION

In view of the foregoing disadvantages inherent in the known static structures (e.g., buildings) art, the present disclosure provides a novel panelized pre-finished siding system and method. The general purpose of the present disclosure, which will be described subsequently in greater detail, is to provide an efficient and effective panelized pre-finished siding system for use in construction projects.

The present invention is a panelized pre-finished siding system with a locking edge. The invention is a pre-finished siding panel system that can be installed in any weather condition without extra preparation or consideration. It utilizes a "SL" trim lock system that can be installed by professionals or can be used by the DIY (do-it-yourselfer). It provides a weather tight cladding system that adds aesthetic appeal and insulation value to the building envelope. A joint solution/compound may or may not be used for additional sealing. Additional anchoring may be used down the right side of the panel ensuring joints remain secured.

A panelized pre-finished siding system in a preferred embodiment is disclosed herein comprising: at least one pre-finished panel assembly, each at least one pre-finished panel assembly including a body having a front-face comprising a pre-finish-surface, a rear-face, and a thickness, with an integrated drainage system. The panelized pre-finished siding system comprises a plurality of the at least one pre-finished panel assemblies installed in functional and locked (interlocked) combination. The body is defined by the front-face, and the rear-face separated by the thickness; the rear-face mounted (fastened via fastening means) adjacent a host-building in-use. The integrated drainage system comprises an exterior channel; wherein the exterior channel is sloped from center to promote drainage and a slight overlap during installation of an upper-panel over a lower-panel sheds liquid from the front-face outwardly. The integrated drainage system further comprises a drainage-channel passing around the perimeter of the body (these are interconnected between panels via locking together, snap-fitting or the like). The body is mountable to the host-building via a nail-anchor-strip and at least one fastener; wherein the nail-anchor-strip further functions as a top-panel-support. The body has at least one tongue and groove profile on a top and bottom of the body. Longitudinal edges and longitudinal edges may be tongue and groove or other suitable recess (female/male coupling means) to connect and lock the panels in functional combination.

The present invention may further comprise a cross-panel-support with nail-anchor mounted on a right-side of the rear-face of the body; wherein the cross-panel-support is an I-channel and is centered on the right-side of the rear-face of the body, and may further comprise a nail-strip; wherein the nail-strip preferably comprises slotted-apertures to allow for expansion and contraction caused by ambient temperatures. The nail-strip comprises perforations to allow flow of liquid (water, condensation, etc.) downwardly.

The drainage-channel mentioned herein is vertically oriented relationally speaking when the panelized pre-finished siding system is in use; wherein the drainage-channel is vertically oriented preferably ½ inch deep with a cross-hatch adjacent the front-face of the body. Other dimensionings may be used. At least one pre-finished panel assembly comprises a pre-finish-surface or other such desired finish (e.g. stucco, acrylic, cork compounds, stained concrete or patterned concrete finishes) to provide pleasing and functional aesthetics. As such the integrated drainage system is integrated into each body such that when in combination the panelized pre-finished siding system is interlocked between panels, the panels being installed on the host-building, is protected from damage due to environmental elements.

The panelized pre-finished siding system may further comprise a set of instructions; wherein the panelized pre-finished siding system is arranged as a kit for sale to a DIY (do-it-yourself) or commercial installer.

A method of use/installation for the panelized pre-finished siding system is also disclosed herein the method comprising the steps of: providing the panelized pre-finished siding system comprising: at least one pre-finished panel assembly, each of the at least one pre-finished panel assembly including, a (substantially 3-D rectangular) body having a front-face comprising a pre-finish-surface, a rear-face, a thickness, and an integrated drainage system; and installing (from left to right) a plurality of the pre-finished panel assemblies in an inter-locked relationship to form a cladding; the front-face comprising the pre-finish-surface outwardly facing and the rear-face adjacent an exterior wall of a host-building such that the host-building is protected from damage due to environmental elements via liquid (rain, condensation, melted snow and ice) being transferred using the integrated drainage system away from the host-building. The method may further comprise the steps of installing the pre-finished panel assemblies as the panelized pre-finished siding system over a building wrap, a first-course starter strip perforated for both front and back drainage, the integrated drainage systems to drain the liquid downwardly to the ground and installing a cap to finish a top-course; wherein the panelized pre-finished siding system is able to be installed in a range of weather conditions. Trim of various profiles may be used as needed. The present invention is mounted via any suitable fastening means.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a panelized pre-finished siding system, constructed and operative according to the teachings of the present disclosure.

The Various Embodiments of the Present Invention Will Hereinafter be Described in Conjunction with the Appended Drawings, Wherein Like Designations Denote Like Elements.

DETAILED DESCRIPTION

As discussed above, embodiments of the present disclosure relate to static structures (e.g., buildings) and more particularly to a panelized pre-finished siding system as used to improve the ease of installation of different finishes in panel form on construction projects.

Generally, the prefinished panel system can be installed in virtually any weather without extra preparations or additional considerations. When combined with the "SL" trim lock system the present invention can be installed by professional or the DYI (do-it-yourselfer). The prefinished panels comprise a locking edge. The system installs over building wrap and begins with a starter strip along the bottom of the wall or area of wall. All trim is installed prior to installing any panels. Working from left to right each course is started at the left and fitting into the left hand trim (fits under trim). Once a desired height is reached or the wall is completely clad a cap piece is installed to finish the top course.

What the system achieves: a weather tight cladding system that adds beauty and insulation value to the building envelope; an "all season" solution for installations in a traditional siding application. The present system can be installed as easily as vinyl siding and in all the same conditions, i.e. rain and cold do not affect the ability to install this system. Residential products may have various panel sizes and geometric design possibilities. For commercial jobs the panels may be built to spec in whatever size is required. Residential panels may be re-enforced with vinyl (or similar suitable material) "H" beams (or I-channels) installed horizontally through the panel. Commercial panels may be re-enforced with heavier metal or similar "H" beams to compensate for higher shear strength of winds at height. The system installs like traditional siding systems right over the building wrap (tar paper or TYVEK™).

The present device features: 1. A tongue and groove interlocking edge; 2. An integrated drainage system; 3. Easy installation; 4. Is cost effective; 5. All weather installation; and 6. Manufactured in a controlled environment. Additional benefits would be 1) A dual drainage system; and 2) Integrated support system to prevent the panel(s) from bending/bulging from expansion and contraction (also allows panel to move horizontally); and 3) Additional anchoring down the right side of panel ensuring joints remain secured.

Referring now more specifically to the drawings by numerals of reference, there is shown in FIGS. 1-4, various views of a panelized pre-finished siding system 100.

Figure 1:
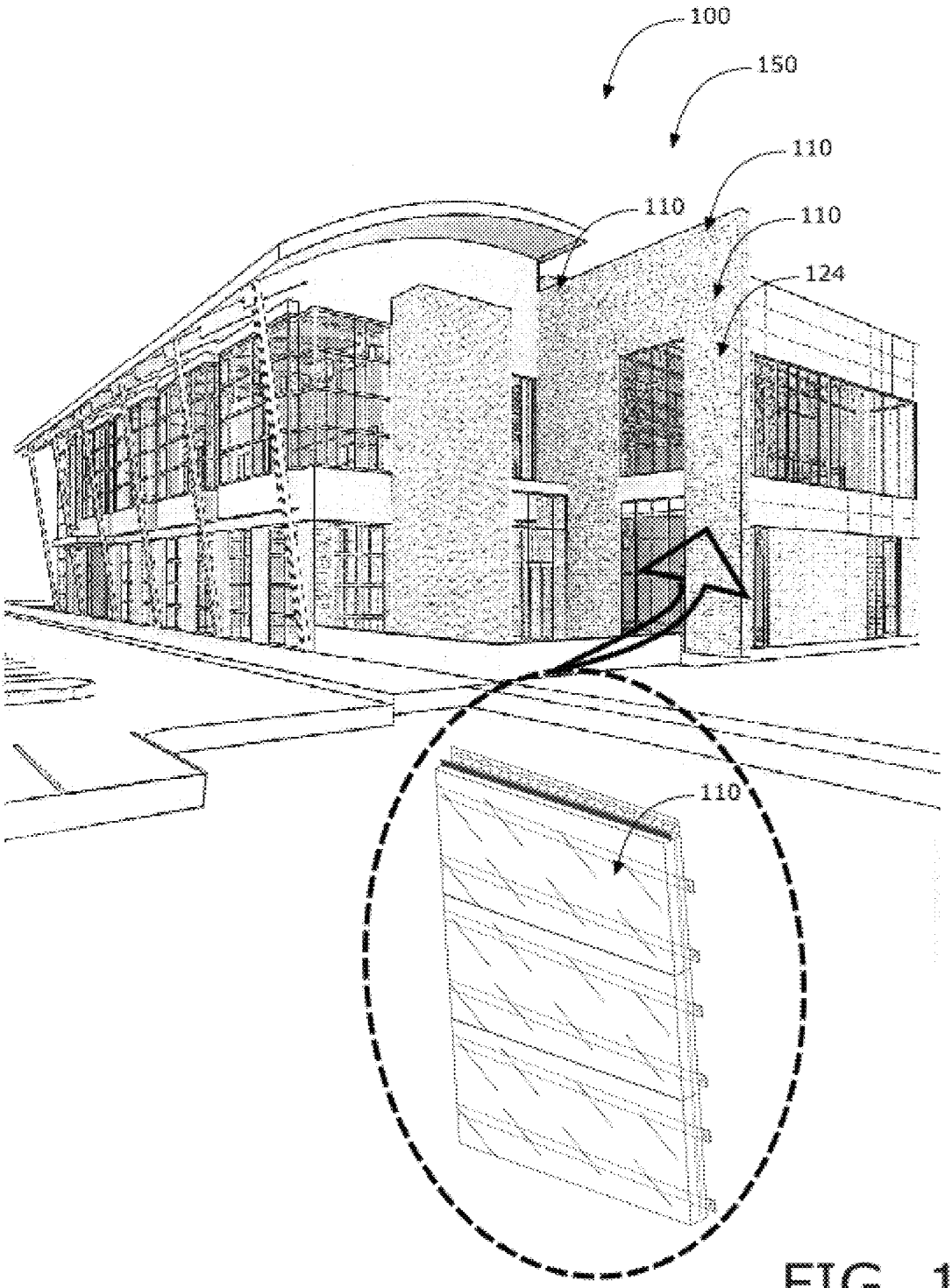
FIG. 1 is a perspective view of the panelized pre-finished siding system during an 'in-use' condition, according to an embodiment of the disclosure.

FIG. 1 shows a panelized pre-finished siding system 100 during an 'in-use' condition 150, according to an embodiment of the present disclosure. Here, the panelized pre-finished siding system 100 may be beneficial for use by a user to install pre-finished panels with esthetically-pleasing finishes on buildings. As illustrated, the panelized pre-finished siding system 100 may include at least one pre-finished panel assembly 110, each of at least one pre-finished panel assemblies 110 including a body 120 having a front-face 122 comprising a pre-finish-surface 124 (stucco or the like), a rear-face 126, and a thickness 128, and an integrated drainage system 130. The panelized pre-finished siding system 100 comprises a plurality of the at least one pre-finished panel assembl(ies) 110 installed in functional combination as shown.

Referring now to the panel assemblies 110; the body 120 is defined by the front-face 122, the rear-face 126 separated in distance by (and joined by) the thickness 128; the rear-face 126 mounted adjacent a host-building in-use (when installed). The integrated drainage system 130 is integrated into each body 120 of the pre-finished panel assembly 110 such that when in combination the panelized pre-finished siding system 100 when installed and locked modularly on the host-building is protected from damage due to environmental elements such as rain, and the like.

According to one embodiment, the panelized pre-finished siding system 100 may be arranged as a kit. In particular, the panelized pre-finished siding system 100 may further include a set of instructions 155. The instructions 155 may detail functional relationships in relation to the structure of the panelized pre-finished siding system 100 such that the panelized pre-finished siding system 100 can be installed, used, maintained, un-installed or the like, in a preferred manner.

Figure 2:
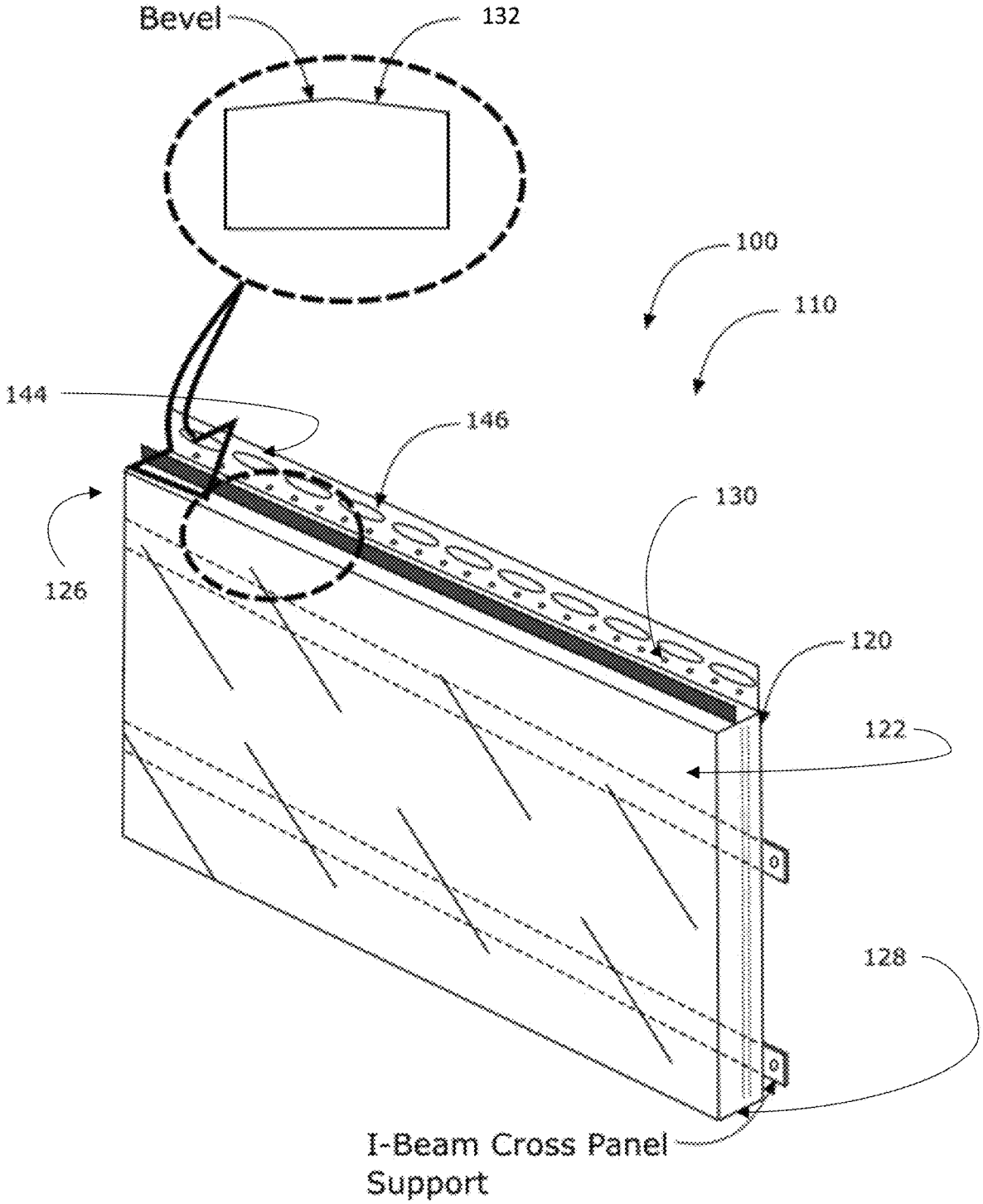
FIG. 2 is a perspective front view of the panelized pre-finished siding system of FIG. 1, according to an embodiment of the present disclosure.
Figure 3:
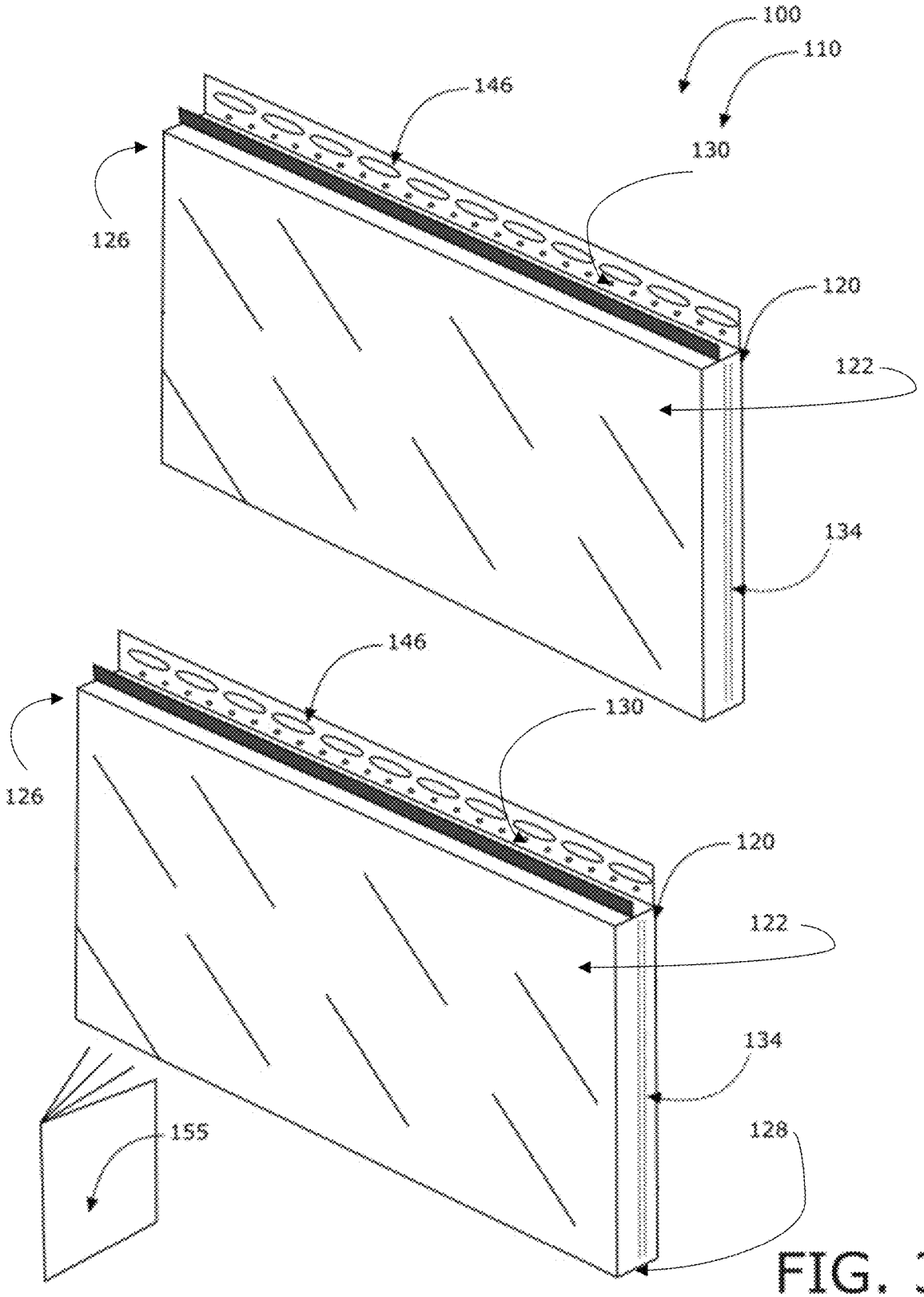
FIG. 3 is a perspective view of the panelized pre-finished siding system of FIG. 1, according to an embodiment of the present disclosure.
Figure 4:
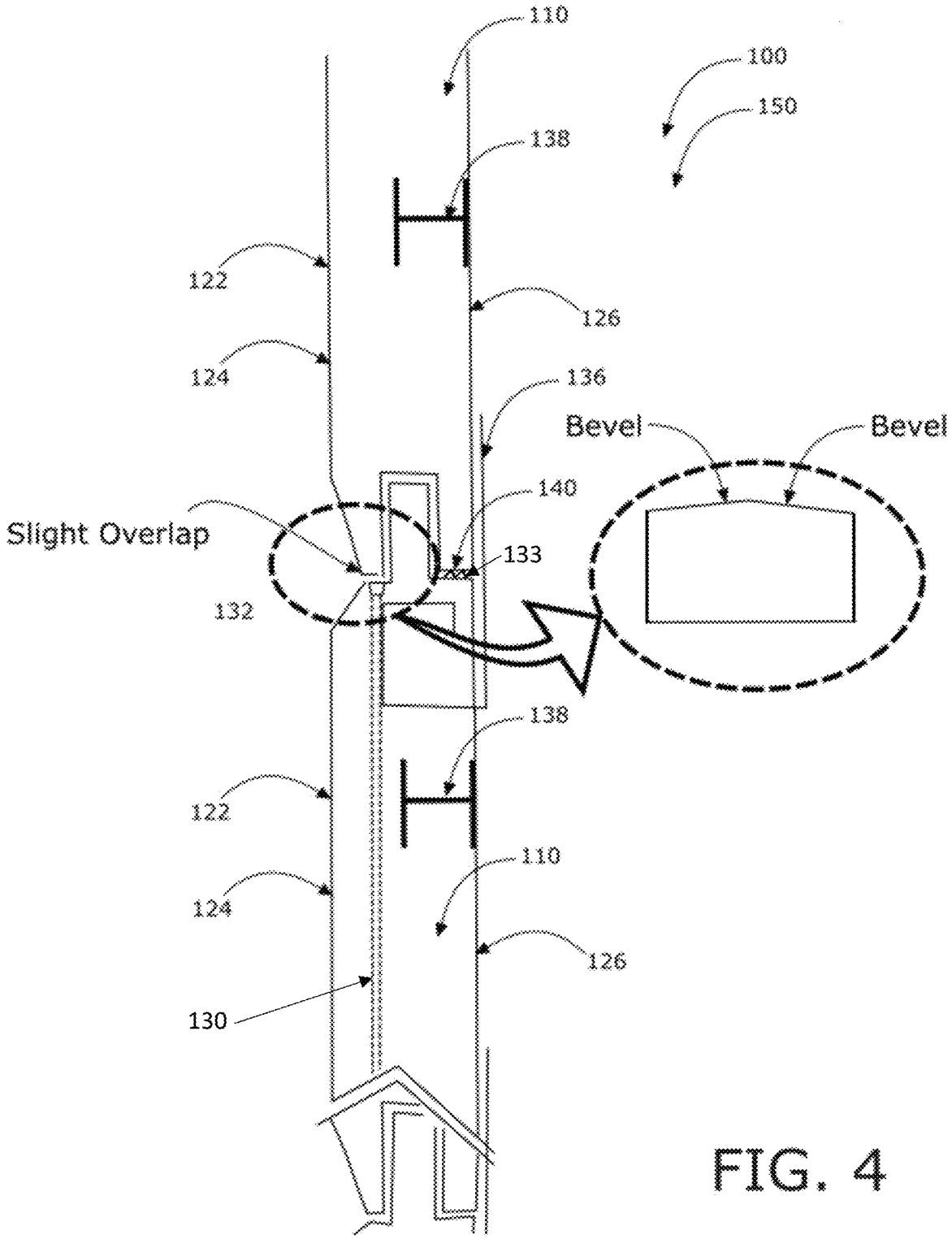
FIG. 4 is a cross-sectional view of the panelized pre-finished siding system of FIG. 1, according to an embodiment of the present disclosure.

Referring now to FIGS. 2-4 showing various views of the panelized pre-finished siding system 100 of FIG. 1, according to an embodiment of the present disclosure.

Figure 2B:
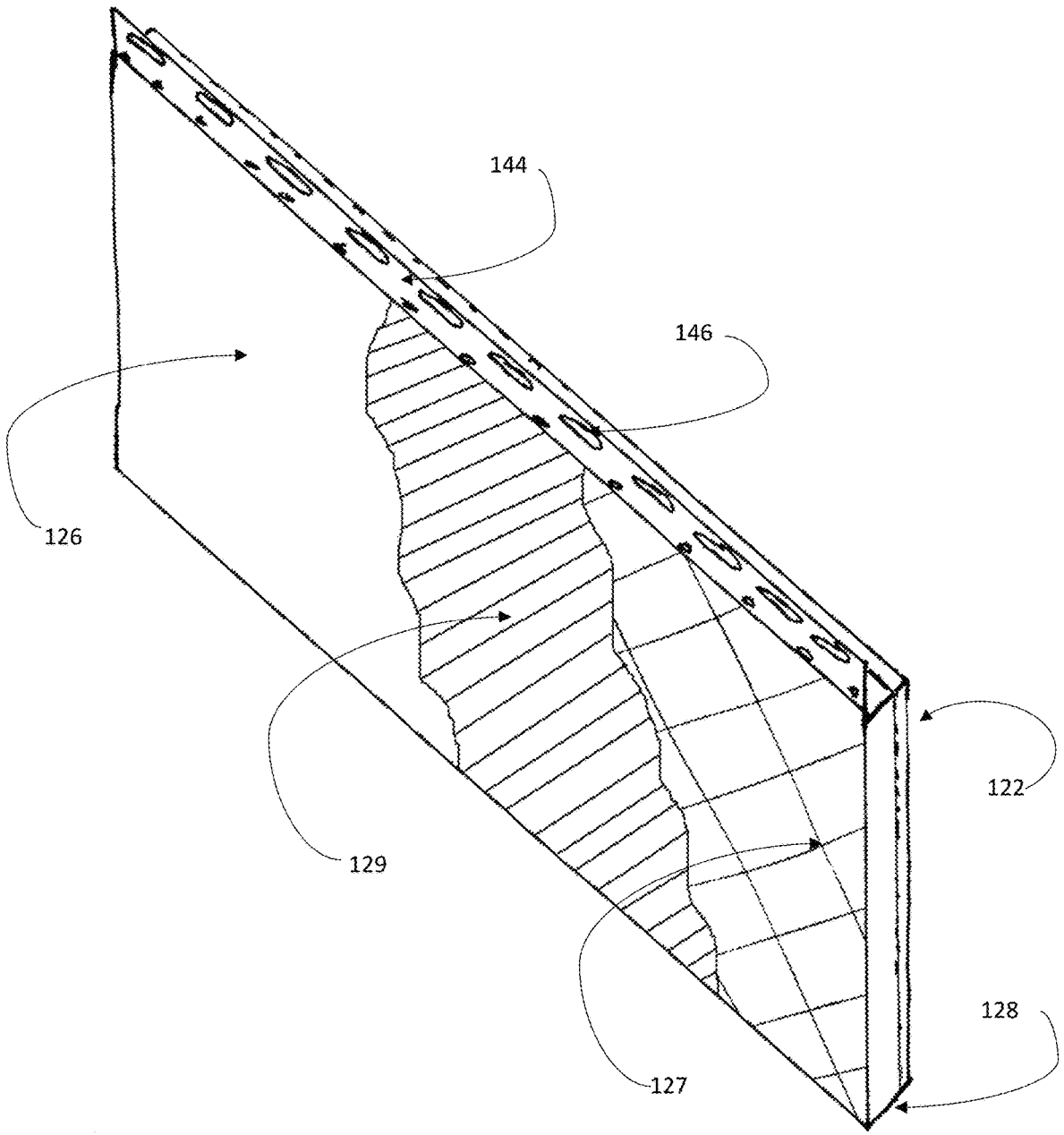
FIG. 2B is a perspective rear view of the panelized pre-finished siding system of FIG. 1, according to an embodiment of the present disclosure.
Figure 2C:
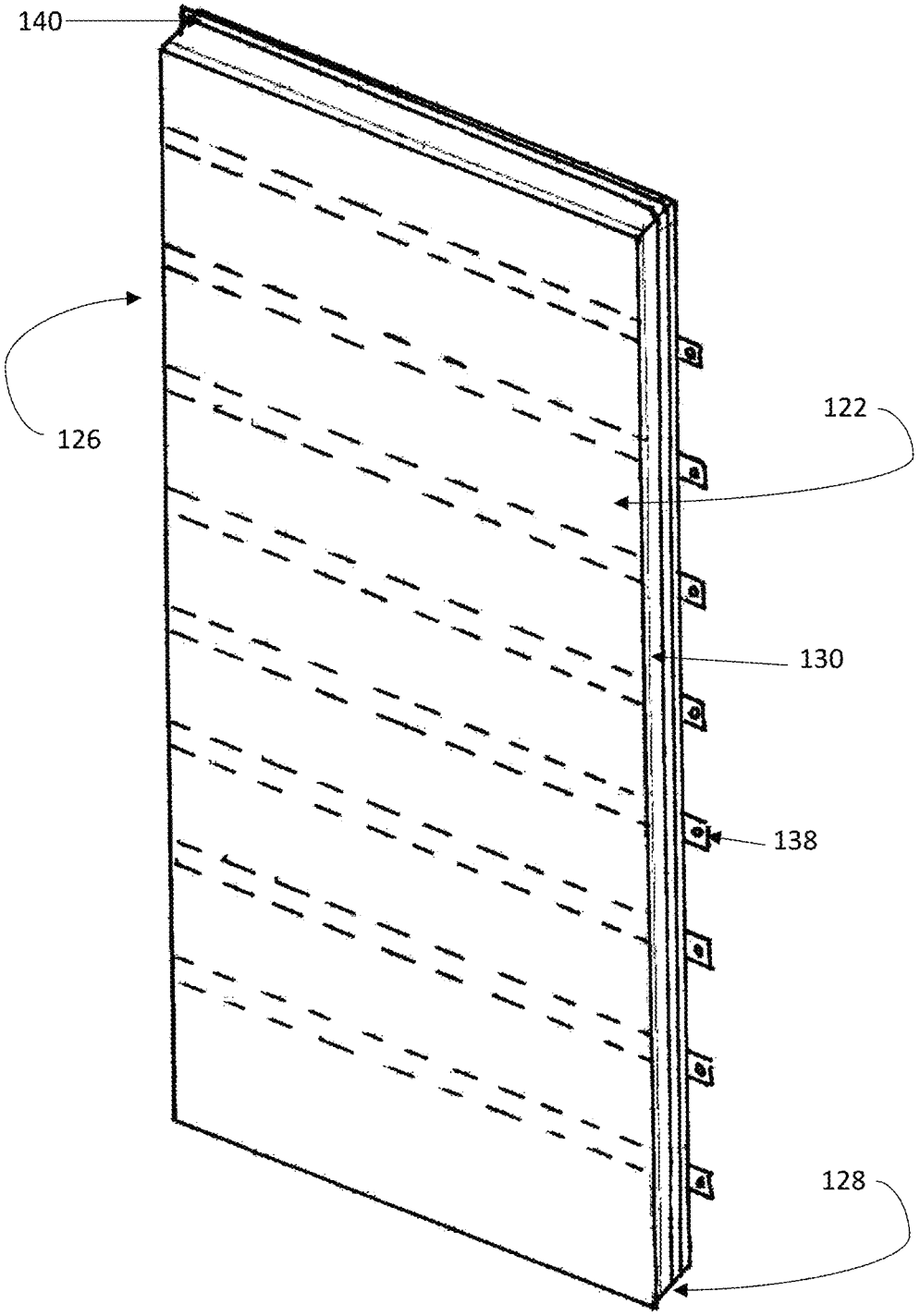
FIG. 2C is a perspective view of the panelized pre-finished siding system of FIG. 1, for vertical installation according to an embodiment of the present disclosure.

The integrated drainage system 130 of the panelized pre-finished siding system 100 comprises an exterior channel 132; wherein the exterior channel 132 is sloped from center or beveled as shown. The bevel is shown such that the watershed is provided towards the outer edges of the panel. An optional top tongue 140 is shown which may be omitted if a vertically installed panel is of adequate height for capping (i.e. both wall and panel are of same height dimension). This feature is optional for vertical installations as shown in FIG. 2C and is not needed if both wall and panel are of the same dimension. The integrated primary drainage system 130 also preferably further comprises a drainage-channel 134 passing around the perimeter of the body 120. The body 120 is mountable to the host-building via a nail-anchor-strip 136 and at least one (suitable) fastener/fastening means. The nail-anchor-strip 136 further functions as a top-panel-support and may be made of a non-conducting material to avoid compromising insulation value. Again, the nail strip 136 may be omitted for vertically installed panels where the wall and panel are of the same dimension. Upon reading this specification, it should be appreciated that, under appropriate circumstances, considering such issues as user preferences, design preference, structural requirements, marketing preferences, cost, available materials, technological advances, etc., other fastening means arrangements such as, for example, screws, nails, clips, clasps, adhesive, non-adhesive, etc., may be sufficient.

The body 120 preferably has at least one tongue and groove profile 140 which may be found on one or more side edges (top, bottom, right-side, left-side) such that the panels can be interlocked and effectively seal the host-building from weather. The panelized pre-finished siding system 100 may further comprise a cross-panel-support 138 with nail-anchor mounted on a right-side of the rear-face 126 of the body 120; wherein the cross-panel-support 138 is centered on the right-side of the rear-face 126 of the body 120 or as otherwise required for support throughout panel body 120. The panelized pre-finished siding system 100, further comprises a nail-strip 144; wherein the nail-strip 144 comprises slotted-apertures 146 to allow for expansion and contraction due to ambient environmental temperatures. In this way the present invention is suitable for installation in a wide range of climates (from extreme hot to extreme cold and in-between). The nail-strip 144 comprises perforations to allow flow of liquid (such as rain water or melting snow and ice) downwardly into and along cross hatch back panel secondary drainage 127 as shown in FIG. 2B.

Referring now to the drainage-channel 134 of the integrated drainage system 130; the drainage-channel 134 is vertically oriented when the panelized pre-finished siding system 100 is in use (installed as shown in FIG. 1). The drainage-channel 134 is vertically oriented adjacent the front-face 122 of the body 120. The drainage-channel 134 is interlocked to an adjacent panel's drainage-channel 134 such that the removal of water and moisture is uninterrupted from the top of the host-building down to the ground level. At least one pre-finished panel assembly 110 comprises a stucco pre-finish-surface 124. The panelized pre-finished siding system 100 may alternately comprise a non-stucco pre-finish-surface such as concrete (other textures are envisioned such as painted, stone texture, non-stone texture). Certain embodiments may comprise insulating means.

Figure 5:
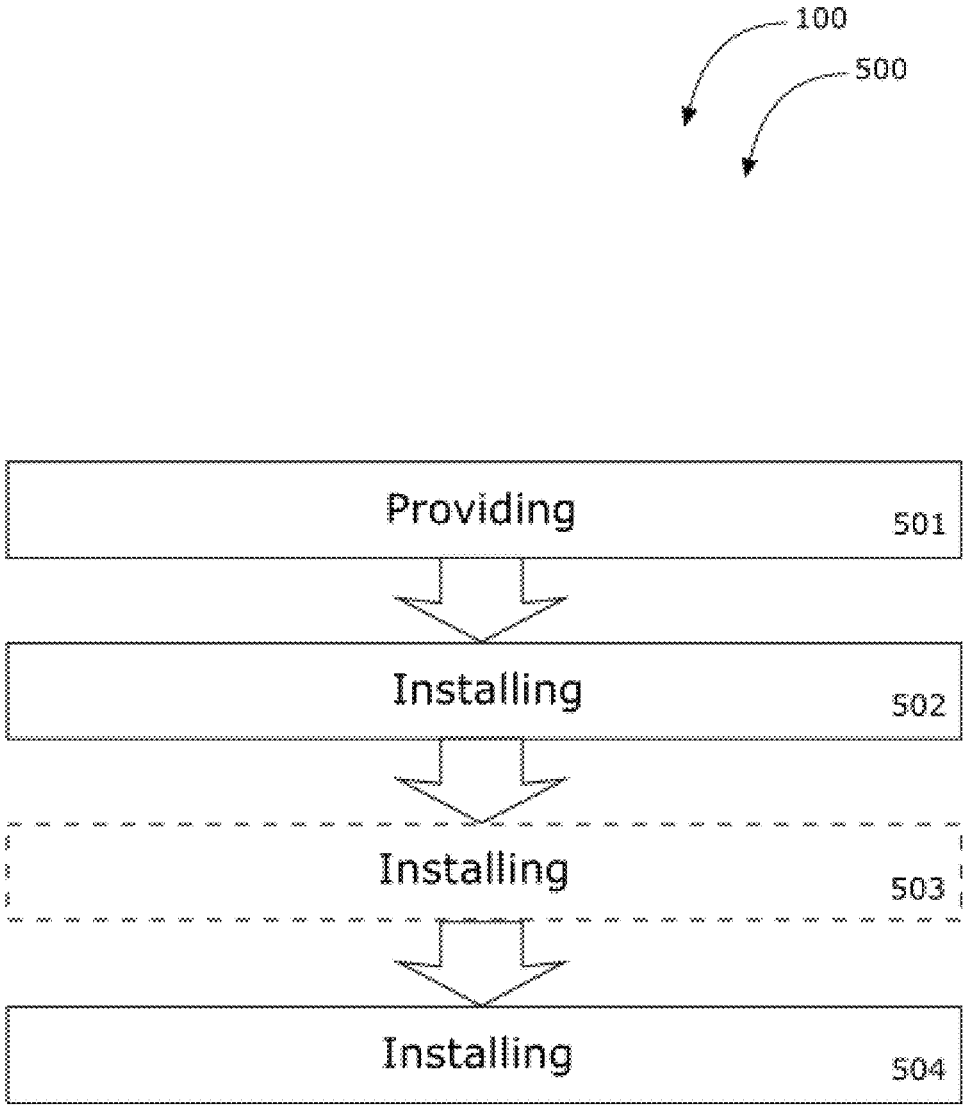
FIG. 5 is a flow diagram illustrating a method of use/installation for the panelized pre-finished siding system, according to an embodiment of the present disclosure.

Referring now to FIG. 5 showing a flow diagram illustrating a method of use/installation 500 for the panelized pre-finished siding system 100, according to an embodiment of the present disclosure. In particular, the method of use/installation 500 may include one or more components or features of the panelized pre-finished siding system 100 as described above. As illustrated, the method of use/installation 500 may include the steps of: step one 501, providing the panelized pre-finished siding system comprising: at least one pre-finished panel assembly, each the at least one pre-finished panel assembly including, a (substantially 3-D rectangular) body having a front-face comprising a pre-finish-surface, a rear-face, and a thickness, and an integrated drainage system; step two 502, installing (from left to right) a plurality of the pre-finished panel assemblies in an interlocked relationship to form a cladding, the front-face comprising the pre-finish-surface outwardly facing and the rear-face adjacent an exterior wall of a host-building such that the host-building is protected from damage due to environmental elements via liquid (rain, condensation, melted snow and ice) being transferred using the integrated drainage system away from the host-building; step three 503, installing the pre-finished panel assemblies as the panelized pre-finished siding system over a building wrap, a first-course starter strip perforated for both front and back, the integrated drainage systems to drain the liquid downwardly to ground and step four 504 installing a cap to finish a top-course; wherein the panelized pre-finished siding system is able to be installed in a range of weather conditions. All trim is preferably installed prior to installing any panels.

It should be noted that step 503 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for installation of the panels are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A panelized pre-finished non-structural decorative siding system comprising:

at least one pre-finished panel assembly, each said at least one pre-finished panel assembly including;

a body having;

a front-face comprising a pre-finish-surface with integrated primary drainage comprising exterior drainage channels along a perimeter of the body;

a rear-face with integrated secondary drainage; and a thickness; and a dual integrated drainage system comprising the primary drainage and secondary drainage, with the body having an exterior channel along a top surface of the body operative to direct water flow from the exterior channel to both the primary drainage and the secondary drainage; and wherein said panelized pre-finished siding system comprises a plurality of said at least one pre-finished panel assembly installed in functional combination without a thermally conducting bridge within each panel and between panels;

wherein said body is defined by said front-face, said rear-face separated by said thickness, said rear-face mounted adjacent a host-building in-use; and wherein said integrated drainage system is integrated into each said body such that said panelized pre-finished siding system being installed and locked modularly on said host-building is further operative to protect said host building from damage due to environmental elements.

2. The panelized pre-finished siding system of claim 1, wherein said integrated primary drainage system comprises an exterior drainage channel vertically oriented along a perimeter of the body.

3. The panelized pre-finished siding system of claim 2, wherein the exterior drainage channel interlocks with an adjacent exterior drainage channel from an adjacent panel.

4. The panelized pre-finished siding system of claim 1, wherein the body has at least one tongue and groove profile.

5. The panelized pre-finished siding system of claim 1, wherein the primary drainage system is vertically oriented adjacent said front-face of said body.

6. The panelized pre-finished siding system of claim 1, wherein the at least one pre-finished panel assembly comprises a pre-finish-surface.

7. The panelized pre-finished siding system of claim 1, further comprising set of instructions; and wherein the panelized pre-finished siding system is arranged as a kit.

8. The panelized pre-finished siding system of claim 1, wherein the top surface of the body comprises a dual beveled surface.

* * * * *